US007959035B2

(12) United States Patent
Pruvot et al.

(10) Patent No.: US 7,959,035 B2
(45) Date of Patent: Jun. 14, 2011

(54) FLUID PRODUCT DISPENSING DEVICE

(75) Inventors: Samuel Pruvot, Saint-Etienne-du-Vauvray (FR); Christophe Fagot, Mezy sur Seine (FR)

(73) Assignee: Valois SAS, Le Neubourg (FR)

( * ) Notice: Subject to any disclaimer, the term of this patent is extended or adjusted under 35 U.S.C. 154(b) by 1163 days.

(21) Appl. No.: 10/576,102

(22) PCT Filed: Oct. 18, 2004

(86) PCT No.: PCT/FR2004/050506

§ 371 (c)(1), (2), (4) Date: Dec. 5, 2006

(87) PCT Pub. No.: WO2005/040010

PCT Pub. Date: May 6, 2005

(65) Prior Publication Data

US 2007/0102451 A1 May 10, 2007

(30) Foreign Application Priority Data

Oct. 20, 2003 (FR) ..... 03 12216

(51) Int. Cl.
*B67D 7/76* (2010.01)

(52) U.S. Cl. ..... 222/189.09; 222/153.1; 222/321.6; 239/333; 128/200.22

(58) Field of Classification Search ..... 239/333; 222/189.06, 189.08, 189.11, 321.6, 383.1, 222/189.09, 105, 153.01–153.14; 604/203; 128/200.22–200.23

See application file for complete search history.

(56) References Cited

U.S. PATENT DOCUMENTS

| | | | | |
|---|---|---|---|---|
| 4,830,284 | A * | 5/1989 | Maerte | 239/333 |
| 5,031,800 | A * | 7/1991 | Brunet | 222/153.06 |
| 5,752,629 | A * | 5/1998 | Hardy | 222/189.09 |
| 5,938,082 | A | 8/1999 | Foster et al. | |
| 6,065,647 | A * | 5/2000 | Bliss et al. | 222/153.02 |
| 6,073,812 | A | 6/2000 | Wade et al. | |
| 6,179,141 | B1 | 1/2001 | Nakamura | |
| 6,257,455 | B1 * | 7/2001 | Trepina et al. | 222/189.09 |
| 6,345,469 | B2 * | 2/2002 | Weder et al. | 47/72 |
| 6,415,962 | B1 | 7/2002 | Bougamont et al. | |
| 2002/0130139 | A1 * | 9/2002 | Shiraishi et al. | 222/105 |
| 2002/0179646 | A1 * | 12/2002 | Petit | 222/173 |
| 2003/0150882 | A1 * | 8/2003 | Bougamont et al. | 222/321.9 |

FOREIGN PATENT DOCUMENTS

| | | | |
|---|---|---|---|
| FR | 2 823 185 | A | 10/2002 |
| WO | WO 99/26860 | A1 | 6/1999 |
| WO | WO 02081101 | A1 * | 10/2002 |

* cited by examiner

*Primary Examiner* — Kevin P Shaver
*Assistant Examiner* — Andrew Bainbridge
(74) *Attorney, Agent, or Firm* — Sughrue Mion, PLLC

(57) ABSTRACT

A fluid product dispensing device that has a container that contains a fluid product, a pump, and a dispensing head that serves as the actuator for the pump. The container is a single molded piece with a neck. The neck of the container has either an opening to accommodate an air filter or has a neck joint that is molded onto the neck of the container, or both. In at least one embodiment, the container also has a shoulder to assist retaining the dispensing head, and a second shoulder to form a maximum amount of actuation.

11 Claims, 4 Drawing Sheets

FLUID PRODUCT DISPENSING DEVICE

This invention relates to a fluid product dispensing device and more particularly a multifunction reservoir made in a single piece.

Fluid product dispensing devices are well known. They usually comprise a reservoir containing the product to be dispensed, a dispensing device such as a pump or a valve fitted on the said reservoir, and a dispensing head to actuate the said dispensing device. Depending on the product type in the reservoir, the dispensing device may comprise a number of characteristics, for example means for avoiding any contamination of the product contained in the dispensing device. These characteristics may include the presence of a filter used to filter air entering inside the reservoir whenever the dispensing device is actuated, or means for preventing the head from being torn off from the dispensing device to prevent contamination of the product at this level. Similarly, this device usually comprises a neck seal placed between the neck of the reservoir and the attachment element fixing the dispensing device on this reservoir. Placement of this seal usually involves an additional assembly step and therefore complicates the assembly by increasing manufacturing and assembly costs of the dispensing device.

The purpose of this invention is to provide a fluid product dispensing device that does not have the above mentioned disadvantages.

More particularly, the purpose of this invention is to provide a fluid product dispensing device that is simple and inexpensive to manufacture and assemble, which integrates several functional characteristics in a single piece to facilitate correct operation of the dispensing device.

Another purpose of this invention is to provide a fluid product dispensing device in which the number of components is minimised.

Therefore, the purpose of this invention is a fluid product dispensing device comprising a reservoir containing the fluid product, a dispensing unit such as a pump or a valve to dispense the product contained in the said reservoir, and a dispensing head to manually actuate the said dispensing unit, the said reservoir being a multifunction reservoir made in a single piece and comprising at least one of the following elements: (a) at least one orifice adapted to hold at least one filter to filter air entering inside the reservoir whenever the dispensing unit is actuated; and (b) a neck seal over moulded on the neck of the said reservoir.

Advantageously, the reservoir also comprises at least a first radial projection cooperating with the said dispensing head to prevent the said head from being torn off.

Advantageously, the said reservoir also comprises at least one second radial projection cooperating with the said dispensing head to define a stop with the said head during actuation thus defining the actuation profile of the dispensing device, the said at least one second radial projection being at an axial spacing from the said at least one first radial projection.

Advantageously, the said at least one filter received at the said at least one orifice is snap-fitted, welded or over moulded on the said reservoir.

Advantageously, the said at least one orifice adapted to hold the said at least one filter is made in a sidewall of the reservoir.

Advantageously, the said reservoir is made by injection blow moulding of a synthetic material, such as a thermoplastic material.

Advantageously, the said over moulded neck seal is an injected thermoplastic elastomer material (TPE), the reservoir and the over moulded seal being made by dual injection blow moulding.

Advantageously, the upper radial surface of the reservoir comprises a reception profile adapted to hold the said over moulded seal.

Other features and advantages of this invention will become clearer after reading the detailed description given below of several embodiments of this invention with reference to the appended figures, given as non-limitative examples and wherein.

Figure 1:
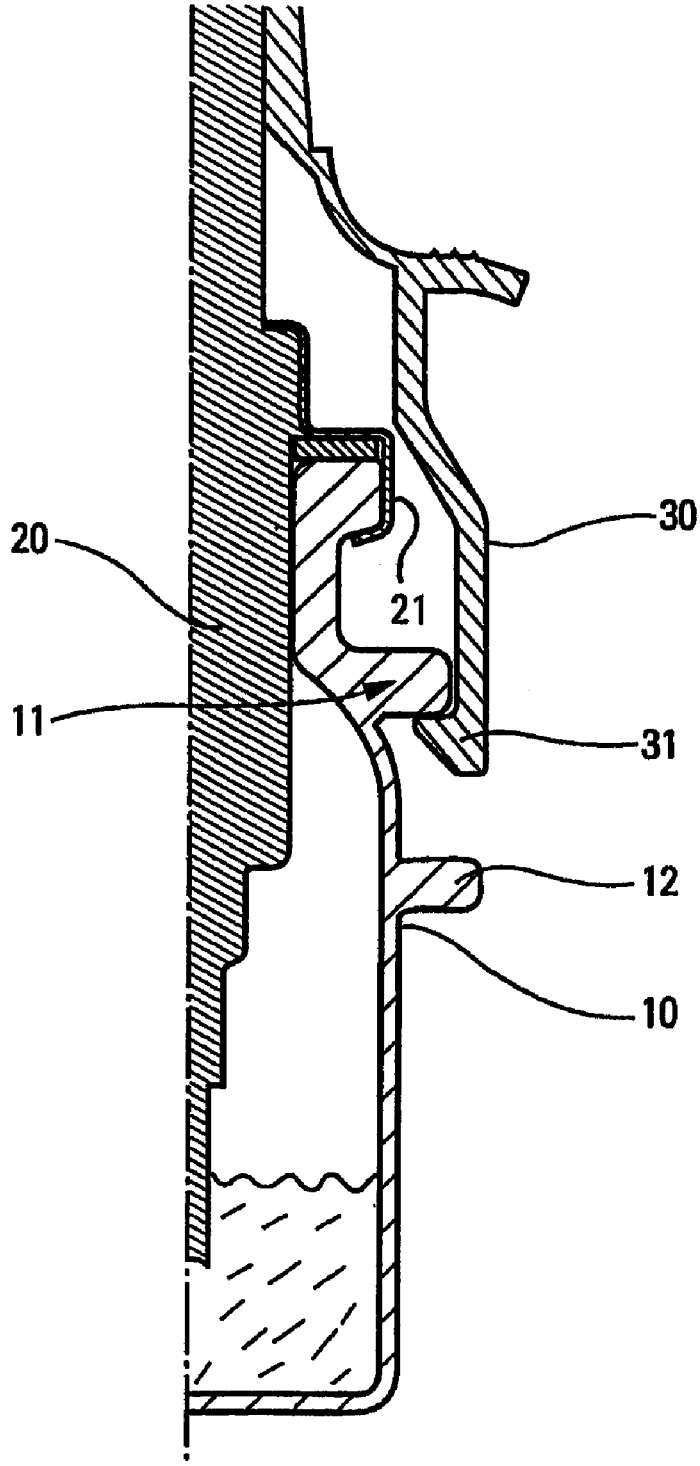
FIG. 1 is a partial cross-sectional diagrammatic view of a fluid product dispensing device according to a first embodiment of this invention.
Figure 2:
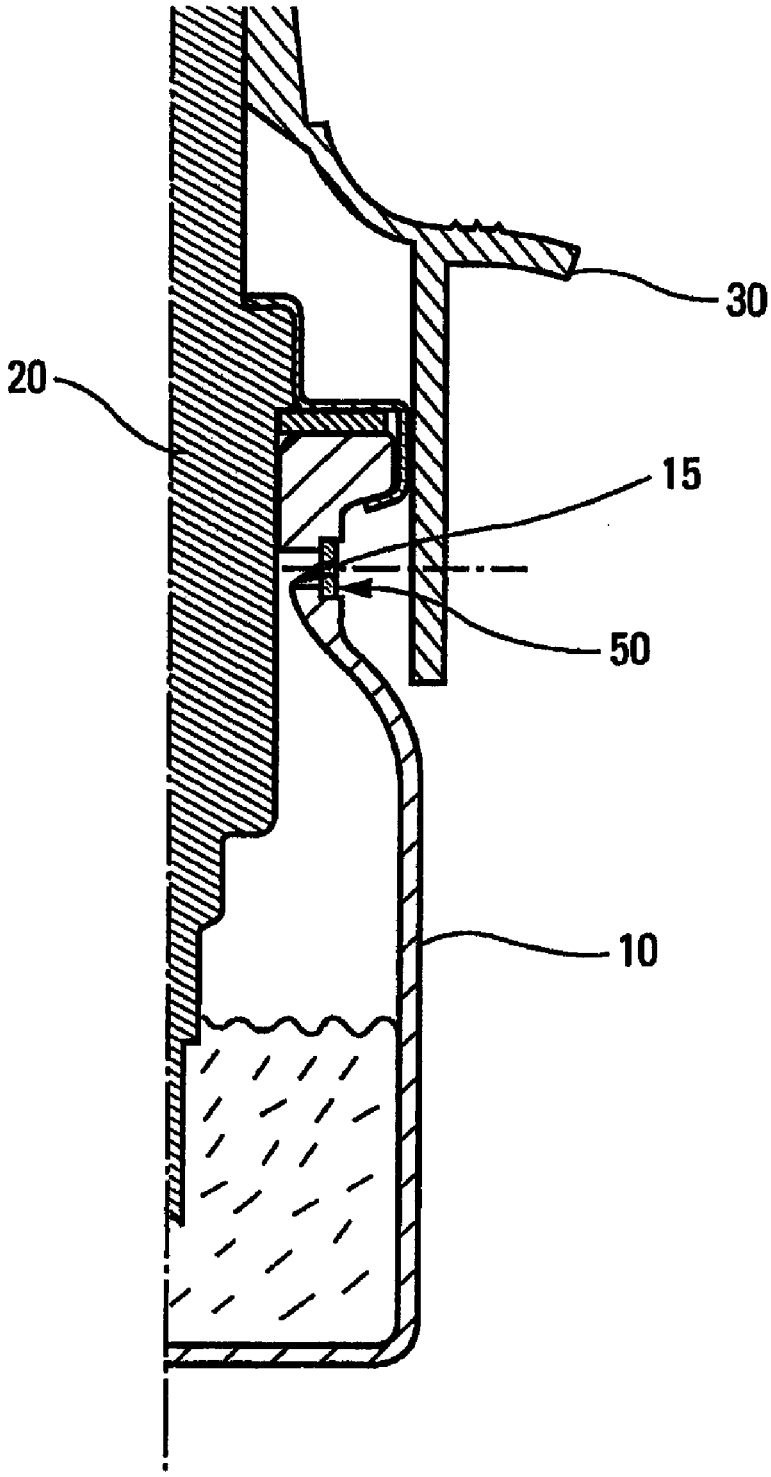
FIG. 2 is a view similar to the view in FIG. 1, showing a second embodiment of this invention.
Figure 3:
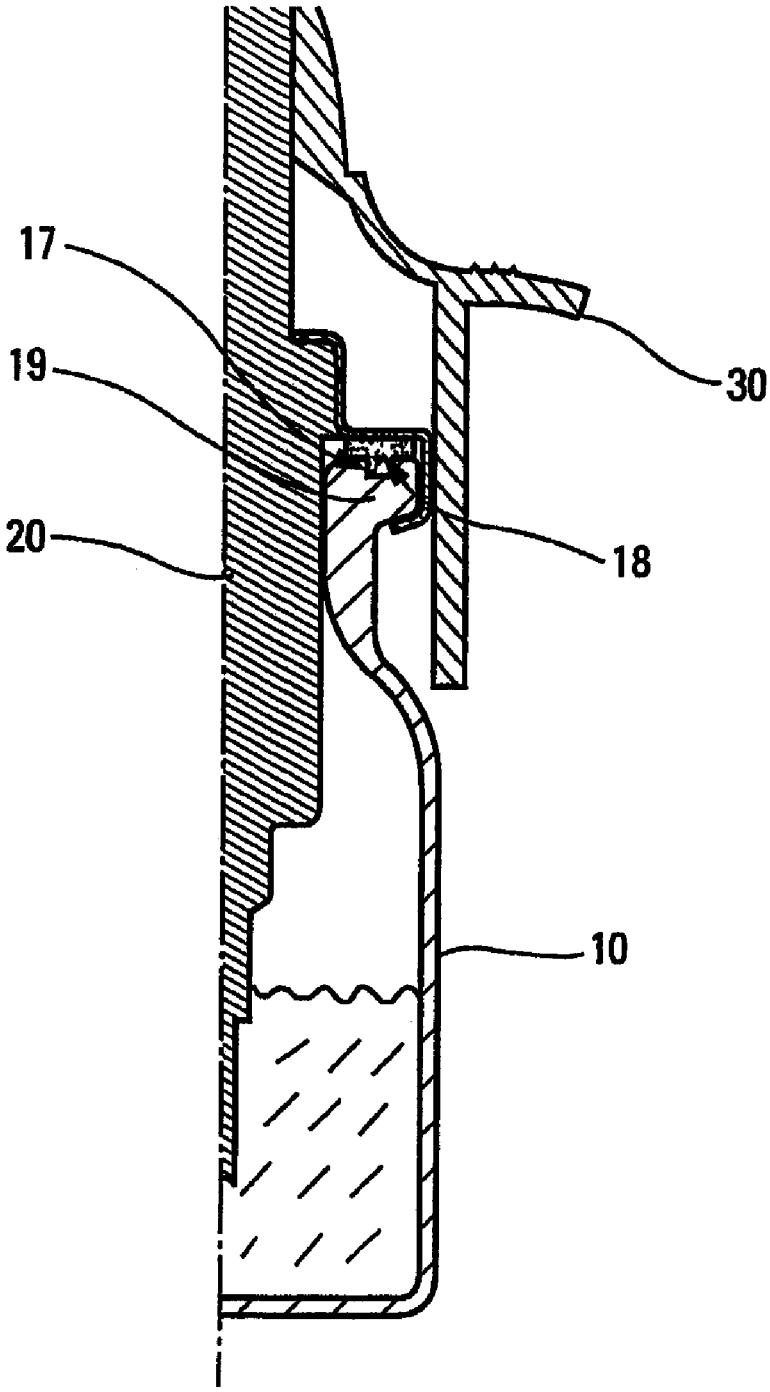
FIG. 3 is a view similar to the views in FIGS. 1 and 2, showing a third embodiment of this invention.
Figure 4:
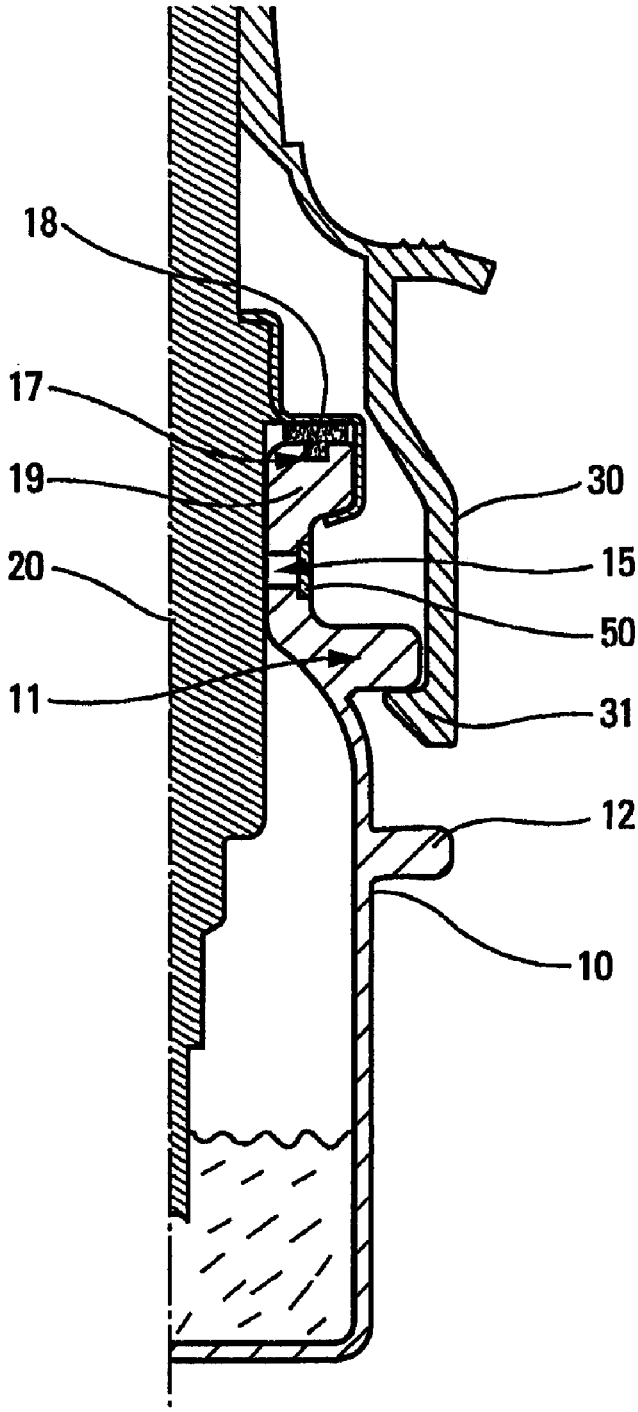
FIG. 4 is a diagrammatic view similar to the views in FIGS. 1 to 3, showing a dispensing device integrating the three embodiments in FIGS. 1 to 3.

This invention is applicable to all fluid product dispensing devices comprising a reservoir containing the product to be dispensed, a dispensing unit such as a pump or a valve mounted on the said reservoir in any manner whatsoever and comprising a dispensing head or actuation pusher mounted on the said dispensing unit to actuate it so as to dispense the product contained in the reservoir. FIGS. 1 to 3 show three distinct embodiments of this invention separately, but it is obvious that this invention also covers any combination of these three embodiments. FIG. 4 in particular shows a variant implementing the three embodiments described in FIGS. 1 to 3.

The Figures very diagrammatically show a dispensing device comprising a reservoir 10 on which a dispensing unit 20, in particular a pump, is mounted. Obviously, the dispensing device 20 may be made differently from a pump, for example in the form of a valve. A dispensing head 30 (or a manual actuation pusher) is assembled on the pump 20 so that it can be actuated manually. To achieve this, the user usually presses on part of the head in the axial direction, which consequently displaces the pump piston inside the body of the pump so as to dispense a dose of product contained in the reservoir. The pump 20 could be actuated differently. The pump 20 may be fixed on the reservoir 10 by means of any attachment ring, for example a crimpable ring 21 like that shown in the figures, or a ring that can be snap fitted or screwed.

According to this invention, a multifunction reservoir 10 is provided that is made in a single piece, and may comprise one or several functional characteristics as will be seen in the following description.

With reference to FIGS. 1 and 4, the reservoir 10 may comprise at least one first radial projection 11 that is adapted to cooperate with the dispensing head 30 and more particularly with a radial shoulder 31 provided in the lateral skirt of the said dispensing head 30. As can be seen in FIG. 1, this cooperation between the said at least one first radial projection 11 and the said dispensing head 30 prevents the head 30 from being torn off, which guarantees a seal and non-contamination of the product at the dispensing orifice (not shown), particularly when it is provided with a shutter. Advantageously, the first projection 11 may also be used to define the stop position at the top dead centre of the dispensing unit, namely the rest position of the dispensing device. The dispensing head may be assembled around the reservoir 30, and in particular the projection 11 may for example be made by snap or click fitting the shoulder 31 on the said projection. The projection 11 may be formed by a continuous annular flange or by one or several distinct projections cooperating with the head 30. Advantageously, the reservoir may also comprise at least one second radial projection 12 that is adapted to cooperate with the dispensing head 30 so as to define a stop with it during actuation. More precisely, this second optional radial projection 12 provides a means for defining the actuation position of the dispensing device, and therefore it is obviously at an axial spacing from the first radial projection 11 to enable the head 30 to displace between these two projections 11 and 12. Advantageously, this second projection 12 can also be used to perform a transport security function, for example by cooperating with a removable clip provided between the head and the said projection. One or both of the radial projection(s) could also be used to define a first use witness, for example using a frangible part, or even to supply a multidose function, by separating the actuation stroke of the dispensing device into several sub-strokes each corresponding to one dose.

FIGS. 2 and 4 show a reservoir comprising at least one orifice 15 adapted to hold at least one filter 50 to filter air entering inside the reservoir 10 after each actuation of the pump 20. This orifice 15 that is a vent hole is advantageously made in a sidewall of the reservoir 10 and it may comprise a reception profile of the filter 50, which may for example be snap fitted, welded or over moulded on the said reservoir 10, at this reception profile.

FIGS. 3 and 4 represent a reservoir 10 comprising a neck seal 18 over moulded on the neck 19 of the reservoir 10. This implementation simplifies the assembly procedure of the pump 20 onto the reservoir 10, in that the neck seal is already prepositioned on the reservoir since it is over moulded on it. Advantageously, the neck 19 of the reservoir 10 and in particular the upper radial surface of the reservoir 10, comprises a reception profile 17 adapted to hold the said over moulded seal 18.

One particular advantage of this invention is that the multifunction reservoir 10 is made from a single piece part by moulding or injection blow moulding. Advantageously, this reservoir is made from a synthetic material such as a thermoplastic material. In the embodiment in which the reservoir comprises an over moulded seal, this seal may be made from an injected thermoplastic elastomer material (TPE), the reservoir 10 and the over moulded seal 18 then being made by dual injection blow moulding.

As explained above, these three embodiments shown in FIGS. 1, 2 and 3 may be combined in any required manner to provide a single piece multifunction reservoir capable of performing several functions simultaneously while being made in a single piece. This is shown particularly in FIG. 4. Therefore this invention can limit the number of components of a fluid product dispensing device, which simplifies manufacturing and assembly of this dispensing device so that it becomes less expensive.

Although the invention has been shown with reference to particular embodiments, it is obvious that it is not limited by the examples shown. On the contrary, those skilled in the art could make many useful modifications without departing from the scope of this invention as defined by the appended claims.

The invention claimed is:

1. Fluid product dispensing device comprising a reservoir (10) containing the fluid product, a dispensing unit (20) to dispense the product contained in the said reservoir (10), and a dispensing head (30) to manually actuate the said dispensing unit (20), wherein the reservoir (10) is a multifunction reservoir made in a single piece and comprising:

(a) at least one orifice (15) adapted to hold at least one filter (50) to filter air entering inside the reservoir (10) whenever the dispensing unit (20) is actuated; and (b) at least a first radial projection cooperating with the dispensing head to prevent the head from being torn off;

wherein the reservoir comprises a neck and wherein the first radial projection is at a bottom of the neck or below the neck of the reservoir.

2. Device according to claim 1, in which the reservoir also comprises a neck seal which is over moulded on the neck of the reservoir.

3. Device according to claim 1, in which the reservoir (10) also comprises at least one second radial projection (12) cooperating with the dispensing head (30) to define a stop with the head (30) during actuation thus defining the actuation profile of the dispensing device, the at least one second radial projection (12) being at an axial spacing from the at least one first radial projection (11).

4. Device according to claim 1, in which the at least one filter (50) received at the at least one orifice (15) is snap fitted, welded or over moulded on the reservoir (10).

5. Device according to claim 1, in which the at least one orifice (15) adapted to hold the at least one filter (50) is made in a sidewall of the reservoir (10).

6. Device according to claim 2, in which the reservoir (10) is made by injection blow moulding of a synthetic material, such as a thermoplastic material.

7. Device according to claim 2, in which the over moulded neck seal (18) is an injected thermoplastic elastomer material (TPE), the reservoir (10) and the over moulded seal (18) being made by dual injection blow moulding.

8. Device according to claim 2, in which the upper radial surface of the reservoir (10) comprises a reception profile (17) adapted to hold the over moulded seal (18).

9. Device according to claim 1, wherein the dispensing unit is a pump or a valve.

10. Device according to claim 1, wherein the reservoir is a one-piece integral construction and the orifice is formed in the one-piece integral construction.

11. A fluid product dispensing device comprising:

a reservoir containing a fluid product;

a dispensing unit that, when actuated, dispenses the fluid product;

a dispensing head to actuate the dispensing unit;

wherein the reservoir is a one-piece integral construction and comprises the following elements:

(a) at least one orifice formed in the one-piece integral construction and adapted to hold at least one filter to filter air entering inside the reservoir, and (b) at least a first radial projection cooperating with the dispensing head to prevent the head from being torn off;

wherein the reservoir comprises a neck and wherein the first radial projection is at a bottom of the neck or below the neck of the reservoir.

* * * * *